US007243628B2

(12) United States Patent
Kim

(10) Patent No.: US 7,243,628 B2
(45) Date of Patent: Jul. 17, 2007

(54) APPARATUS AND METHOD FOR ASSEMBLING CRANKSHAFT-SPROCKET

(75) Inventor: Han Gu Kim, Suwon (KR)

(73) Assignee: Hyundai Motor Company, Seocho-Ku, Seoul (KR)

( * ) Notice: Subject to any disclaimer, the term of this patent is extended or adjusted under 35 U.S.C. 154(b) by 49 days.

(21) Appl. No.: 11/292,397

(22) Filed: Nov. 30, 2005

(65) Prior Publication Data

US 2006/0112551 A1 Jun. 1, 2006

(30) Foreign Application Priority Data

Nov. 30, 2004 (KR) ..... 10-2004-0099290

(51) Int. Cl.
*F01L 1/02* (2006.01)

(52) U.S. Cl. ..... 123/90.31; 123/90.17; 29/888.08

(58) Field of Classification Search ..... 123/90.15, 123/90.16, 90.17, 90.18, 90.27, 90.31, 90.6; 464/1, 2, 160; 29/888.08
See application file for complete search history.

(56) References Cited

U.S. PATENT DOCUMENTS 6,196,085 B1 * 3/2001 Chimonides et al. ..... 74/595

FOREIGN PATENT DOCUMENTS

JP 08-226527 9/1996

* cited by examiner

*Primary Examiner*—Ching Chang
(74) *Attorney, Agent, or Firm*—Morgan Lewis & Bockius LLP

(57) ABSTRACT

An apparatus for assembling a crankshaft-sprocket aligns a timing mark of a sprocket to a predetermined line of a crankshaft, and includes a slider for slidably moving an interior circumference surface of the sprocket to an exterior circumference surface of the crankshaft. A guider is disposed on an end portion of the crankshaft so as to guide the slider to the crankshaft. A first aligner is disposed on the slider so as to align the timing mark of the sprocket to a predetermined portion of the slider. A second aligner aligns the slider such that the timing mark aligned by the first aligner is positioned to the predetermined line of the crankshaft.

9 Claims, 4 Drawing Sheets

APPARATUS AND METHOD FOR ASSEMBLING CRANKSHAFT-SPROCKET

CROSS-REFERENCE TO RELATED APPLICATION

This application claims priority to and the benefit of Korean Patent Application No. 10-2004-0099290 filed in the Korean Intellectual Property Office on Nov. 30, 2004, the entire contents of which are incorporated herein by reference.

BACKGROUND OF THE INVENTION (a) Field of the Invention

The present invention relates to a crankshaft-sprocket assembly, and in particular, to an apparatus and a method for assembling a crankshaft-sprocket.

(b) Description of the Related Art

In general, a crankshaft-sprocket assembly 1, as shown in FIG. 1, is connected to a camshaft-sprocket assembly 5 by a timing belt 3, thereby accurately synchronizing operation timing of a valve 7.

In a type of conventional apparatus for assembling a crankshaft-sprocket a key on the crankshaft, sometimes called a woodruff key, issued to correctly align a timing mark of the sprocket to a predetermined line of a crankshaft. However, this conventional apparatus for assembling a crankshaft-sprocket may have a number of problems. For example, grooves necessary to accommodate the key can reduce durability of the crankshaft. Thus, a crack may be easily generated at a surrounding portion of a key groove as a result of repeated load due to driving of a vehicle.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide an apparatus and a method for assembling a crankshaft-sprocket having advantages of accurately synchronizing operation timing of a valve without a woodruff key.

An apparatus for assembling a crankshaft-sprocket according to an exemplary embodiment of the present invention is to align a timing mark of a sprocket to a predetermined line of a crankshaft, and it includes a slider for slidably moving an interior circumference surface of the sprocket to an exterior circumference surface of the crankshaft, after holding the sprocket; a guider disposed on an end portion of the crankshaft so as to guide the slider to the crankshaft; a first aligner disposed on the slider so as to align the timing mark of the sprocket to a predetermined portion of the slider; and a second aligner for aligning the slider such that the timing mark aligned by the first aligner is positioned to the predetermined line of the crankshaft.

In a further embodiment according to the present invention, the first aligner includes a mounting portion formed at an end portion of the slider so as to mount the sprocket; an inserting hole formed at an exterior circumference surface of an end portion of the slider, and extended to an interior circumference surface of the slider toward a center of the slider; and a pin inserted into the inserting hole, and inserted between teeth formed at an exterior circumference surface of the sprocket, such that the timing mark is aligned to the predetermined portion of the slider.

In another further embodiment according to the present invention, the second aligner includes a catch groove formed at the end surface of the crankshaft, and a catch projection disposed on a determined portion of the end surface of the guider so as to be inserted to the catch groove, wherein the determined portion of the end surface of the guider is determined to a location in which the timing mark aligned by the slider is aligned to the predetermined line when the slider is inserted to the crankshaft along the guider after the catch projection is inserted into the catch groove.

The apparatus for assembling a crankshaft-sprocket according to an embodiment of the present invention further includes a subsidiary guider disposed between an interior circumference surface of the slider and an exterior circumference surface of the guider such that the slider moves straightly along the guider.

In another further embodiment according to the present invention, the subsidiary guider includes a key mounted to the exterior circumference surface of the guider; and a key guider formed at the interior circumference surface of the slider along the length direction of the slider.

In another further embodiment according to the present invention, the crankshaft and the guider are coupled to each other by a coupling unit.

In another further embodiment according to the present invention, the coupling unit includes a screw hole which is formed at the end surface of the crankshaft, a penetration hole penetrating through the guider along a length direction of the guider, and a bolt coupled to the screw hole after being inserted into the penetration hole.

A method for assembling a crankshaft-sprocket according to an embodiment of the present invention includes aligning a predetermined portion of an end potion of a guider to an end portion of a crankshaft using a second aligner; aligning a timing mark of the sprocket to an predetermined portion of a slider using a first aligner, after inserting the sprocket into the slider; thrusting the aligned sprocket into the crankshaft, after inserting the slider into the guider; releasing the first aligner and drawing out the slider, after the sprocket is fixed to the crankshaft; and releasing the second aligner and separating the guider from the crankshaft.

The method for assembling a crankshaft-sprocket according to an embodiment of the present invention further includes heating a sprocket before inserting the sprocket into the crankshaft.

DETAILED DESCRIPTION OF THE EMBODIMENTS

An exemplary embodiment of the present invention will hereinafter be described in detail with reference to the accompanying drawings.

Figure 1:
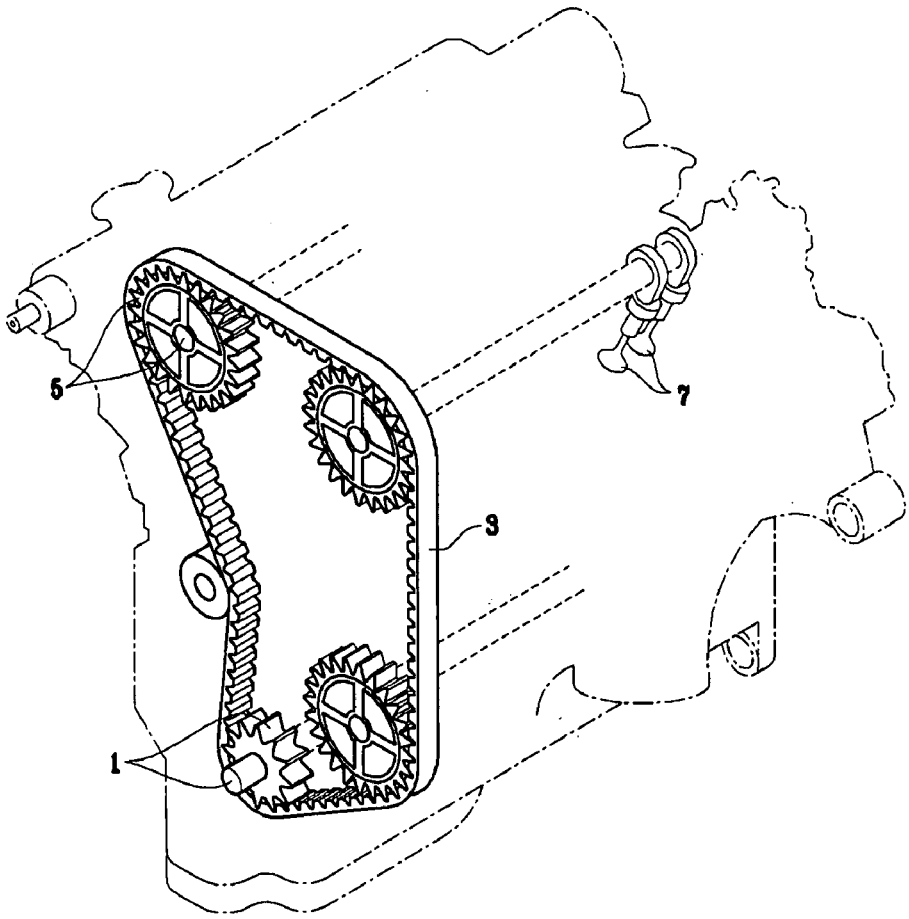
FIG. 1 is a perspective view generally showing a state in which a crankshaft is connected to a camshaft.
Figure 2:
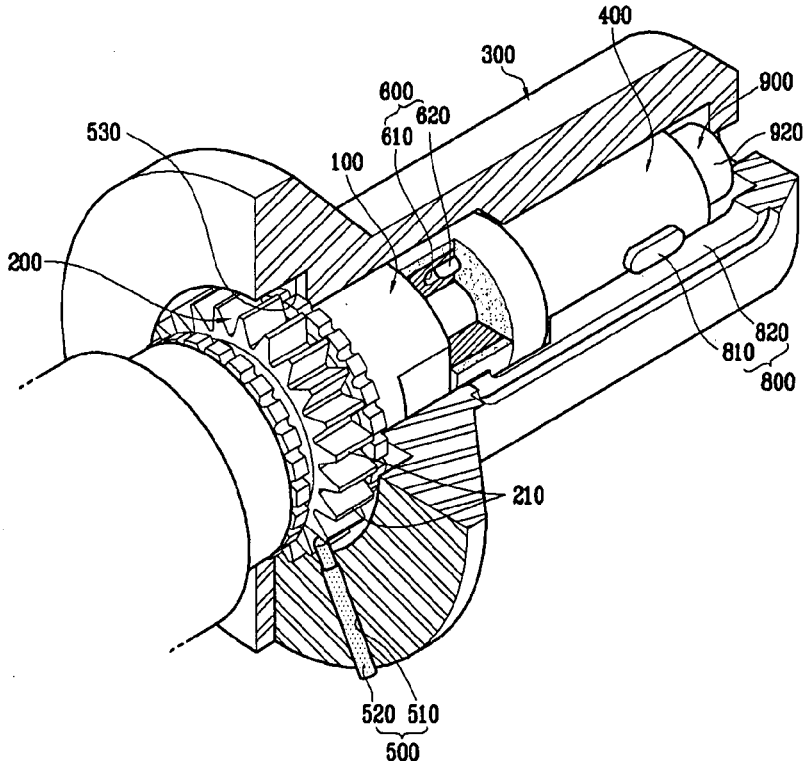
FIG. 2 is a perspective view showing an apparatus for assembling a crankshaft-sprocket according to an exemplary embodiment of the present invention.

As shown in FIG. 2, an apparatus for assembling a crankshaft-sprocket according to an exemplary embodiment of the present invention includes a slider 300, a guider 400, a first aligner 500, and a second aligner 600, so as to align a timing mark (refer to "TM" of FIG. 5) of a sprocket 200 to a predetermined line (refer to "PL" of FIG. 5) of a crankshaft 100.

The slider 300 slidably moves an interior circumference surface of the sprocket 200 to an exterior circumference surface of the crankshaft 100, after holding the sprocket 200. Furthermore, such a slider 300 may be a hollow type such that the guider 400 is inserted thereinto. The guider 400 is disposed on an end portion of the crankshaft 100 so as to guide the slider 300 to the crankshaft 100. The first aligner 500 aligns the timing mark TM of the sprocket 200 to a predetermined portion of the slider 300. The first aligner 500 will hereinafter be described in detail.

Figure 3:
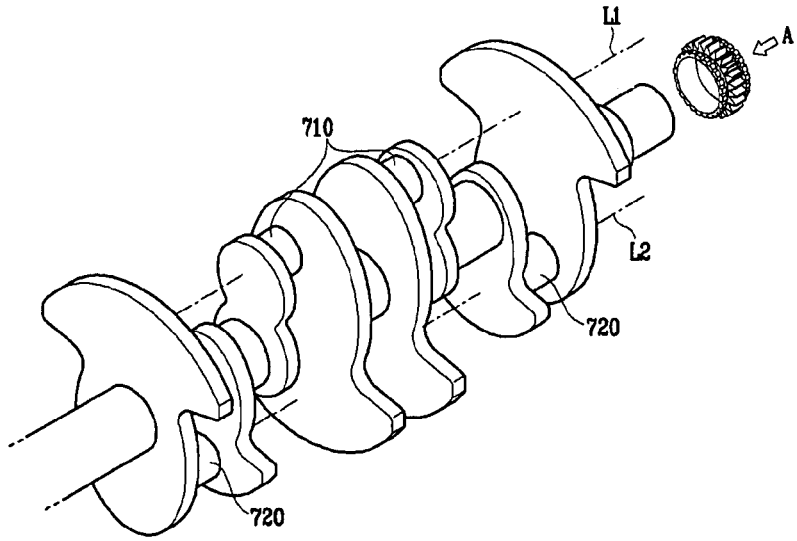
FIG. 3 is a perspective view showing a crankshaft and a crankpin, in an apparatus for assembling a crankshaft-sprocket according to an exemplary embodiment of the present invention.

The first aligner 500, as shown in FIG. 3, may include a mounting portion 530, an inserting hole 510, and a pin 520. The mounting portion 530 is formed at an end portion of the slider 300 so as to mount the sprocket 200. The inserting hole 510 is formed at an exterior circumference surface of an end portion of the slider 300 and is extended to the interior circumference surface of the slider 300 toward a center of the slider 300. The pin 520 is inserted into the inserting hole 510 and is engaged between teeth formed at an exterior circumference surface of the sprocket 200, such that the timing mark TM is aligned to the predetermined portion of the slider 300.

The second aligner 600 aligns the slider 300 such that the timing mark TM aligned by the first aligner 500 is positioned to the predetermined line PL of the crankshaft 100. The second aligner 600 will hereinafter be described in detail.

Figure 5:
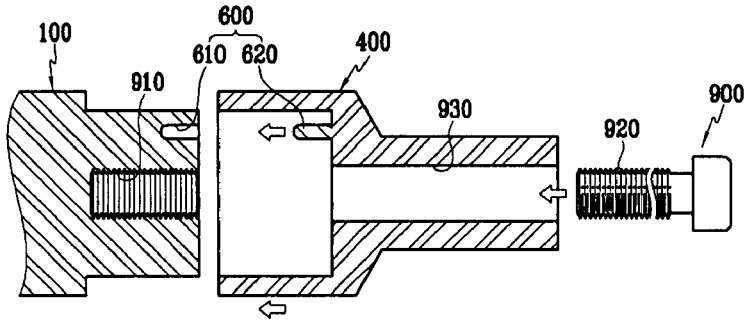
FIG. 5 is a cross-sectional view showing a coupling unit, in an apparatus for assembling a crankshaft-sprocket according to an exemplary embodiment of the present invention.
Figure 6:
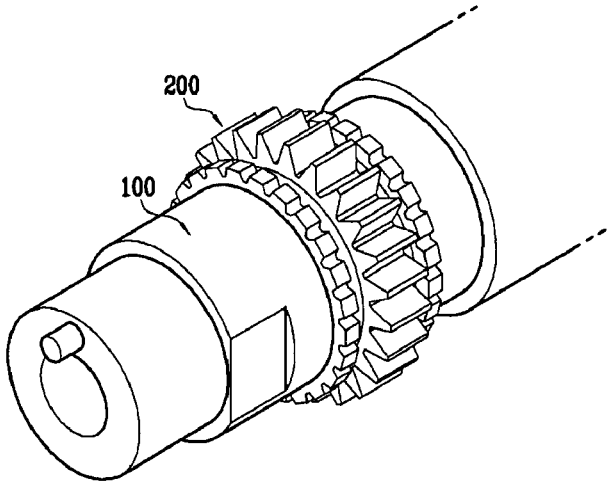
FIG. 6 is a perspective view shows a state in which assembly of a crankshaft-sprocket is finished by an apparatus for assembling a crankshaft-sprocket according to an exemplary embodiment of the present invention.

The second aligner 600, as shown in FIGS. 3, 5, and 6, may include a catch groove 610 and a catch projection 620. The catch groove 610 is formed at the end surface of the crankshaft 100. The catch projection 620 is disposed on a determined portion of the end surface of the guider 400, and is inserted to the catch groove 610.

In particular, the determined portion of the end surface of the guider 400 is determined to be a location in which the timing mark TM aligned by the slider 300 is aligned to the predetermined line PL when the slider is inserted to the crankshaft 100 along the guider 400 after the catch projection 620 is inserted into the catch groove 610.

That is, as one example, the timing mark TM of the sprocket 200 is firstly fixed to the predetermined portion of the slider 300 by the pin 520, and on the basis thereof, the catch projection 620 may be determined such that the timing mark TM is positioned to the predetermined line PL of the crankshaft 100.

In addition, as another example, the guider 400 is firstly fixed to the crankshaft 100 by the catch groove 610 of the crankshaft 100 and the catch projection 620 of a guider 400, and on the basis thereof, the predetermined portion of the slider 300 may be also determined such that the timing mark TM is positioned to the predetermined line PL of the crankshaft 100.

Figure 4:
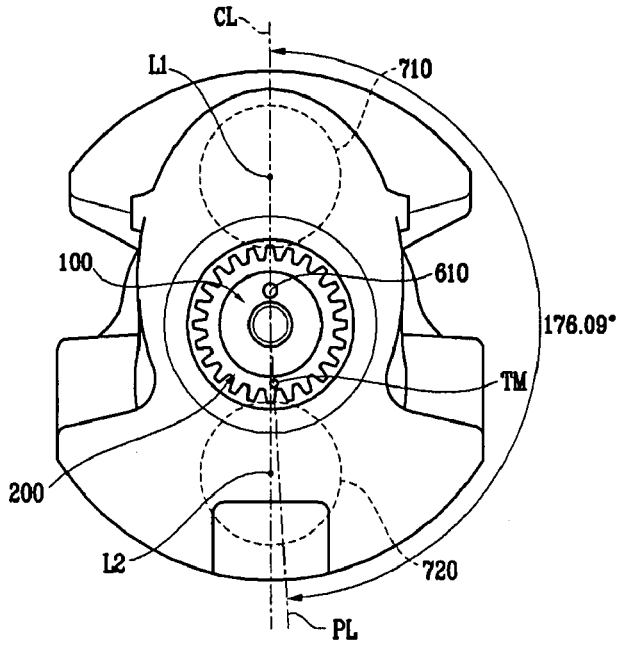
FIG. 4 is a view taken in the direction of the "A" arrow of the FIG. 3, and shows a relation between a timing mark and a predetermined line.

The timing mark TM, as shown in FIG. 4, is assigned to the sprocket 200 when the sprocket is manufactured, and it may vary according to the type of vehicle. In addition, the predetermined line PL of the crankshaft 100, as shown in FIGS. 3 and 4, is a center line located to the predetermined angle (e.g., 176.09°) on the basis of a connection line CL which connects a first center line L1 of an upper crankpin 710 and a second center line L2 of a lower crankpin 720 with each other, and it may vary according to the type of vehicle.

On the other hand, an apparatus for assembling a crankshaft-sprocket according to an exemplary embodiment of the present invention, as shown in FIG. 2, may further include a subsidiary guider 800. In more detail, the subsidiary guider 800 is disposed between an interior circumference surface of the slider 300 and an exterior circumference surface of the guider 400 such that the slider 300 moves straightly along the guider 400. In more detail, the subsidiary guider 800 may include a key 810 which is mounted to the exterior circumference surface of the guider 400, and a key guider which is formed at the interior circumference surface of the slider 300 along the length direction of the slider 300.

In addition, as shown in FIGS. 2 and 5, the crankshaft 100 and the guider 400 may be coupled to each other by a coupling unit 900 such that the guider 400 is not separated from the crankshaft 100 when the slider 300 moves along the guider 400. The coupling unit 900, as shown in FIG. 6, may include a screw hole 910, a penetration hole 930, and a bolt 920. In more detail, the screw hole 910 is formed at the end surface of the crankshaft 100. The penetration hole 930 penetrates through the guider 400 along a length direction of the guider 400. The bolt 920 is coupled into the screw hole 910 after being inserted into the penetration hole 930.

A method for assembling the crankshaft-sprocket according to the exemplary embodiment of the present invention will hereinafter be described in detail with reference to FIGS. 2 to 6.

First, the sprocket 200 having the timing mark TM, the guider 400, the slider 300, and the bolt 920 are provided.

Second, the catch projection 620 formed at the predetermined portion of the guider 400 is inserted into the catch groove 610 formed at the end surface of the crankshaft 100, and thereby the guider 400 is aligned to the crankshaft 100. Thereafter, the bolt 920 is inserted into the penetration hole 930 of the guider 400, and is coupled to the screw hole 910 formed at the end surface of the crankshaft 100.

Third, the sprocket 200 is mounted to the mounting portion 530 of the slider 300. At the same time, the timing mark TM of the sprocket 200 is aligned to the predetermined portion of the slider 300 by the pin 520 inserted into the inserting hole 510.

In particular, the sprocket 200 may be heated so as to smoothly insert the crankshaft 100 therein. The sprocket 200 may, as an example, be heated before the sprocket 200 is inserted into the mounting portion 530 of the slider 300.

It is most preferable that the sprocket 200 is heated before the sprocket 200 is inserted onto the crankshaft.

Fourth, the key guider 820 formed at the interior circumference surface of the slider 300 is inserted into the key 810 disposed on the exterior circumference surface of the guider 400, and the sprocket 200 fixed to the slider 300 moves straightly to the crankshaft 100 along the subsidiary guider 800.

In the result, the heated sprocket 200 is cold-fixed to the crankshaft 100, and the timing mark TM of the sprocket 200 is aligned to the predetermined line PL of the crankshaft 100.

Finally, the pin 520 is disengaged from the sprocket 200, and the slider 300 is drawn out. The bolt 920 is uncoupled from the screw hole 910, and thereby the guider 400 is separated from the crankshaft 100, as shown in FIG. 6, and a crankshaft-sprocket is assembled.

As has been explained, an apparatus and a method for assembling a crankshaft-sprocket according to an embodiment of the present invention may have a number of advantages. For example, a conventional woodruff key is not employed, that is, the conventional key groove is not formed at the crankshaft, and therefore durability of the crankshaft can be increased. In addition, once predetermined portions are defined, assembly work can be continuously performed by the defined apparatus so working time can be reduced. In addition, all the advantages described in the specification are included with in the spirit and scope of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for assembling a crankshaft-sprocket such that a timing mark of a sprocket is positioned to a predetermined line of a crankshaft, comprising:

a slider for slidably moving an interior circumference surface of the sprocket to an exterior circumference surface of the crankshaft, after holding the sprocket;

a guider disposed on an end portion of the crankshaft so as to guide the slider to the crankshaft;

a first aligner disposed on the slider so as to align the timing mark of the sprocket to a predetermined portion of the slider; and a second aligner for aligning the slider such that the timing mark aligned by the first aligner is positioned to the predetermined line of the crankshaft.

2. The apparatus of claim 1, wherein the first aligner comprises:

a mounting portion formed at an end portion of the slider so as to mount the sprocket;

an inserting hole formed at an exterior circumference surface of an end portion of the slider, and extended to an interior circumference surface of the slider toward a center of the slider; and a pin inserted into the inserting hole, and inserted between teeth formed at an exterior circumference surface of the sprocket, such that the timing mark is aligned to the predetermined portion of the slider.

3. The apparatus of claim 2, wherein the second aligner comprises:

a catch groove formed at the end surface of the crankshaft; and a catch projection disposed on a determined portion of the end surface of the guider so as to be inserted to the catch groove, wherein the determined portion of the end surface of the guider is determined to be a location in which the timing mark aligned by the slider is aligned to the predetermined line when the slider is inserted to the crankshaft along the guider after the catch projection is inserted into the catch groove.

4. The apparatus of claim 1, further comprising a subsidiary guider disposed between an interior circumference surface of the slider and an exterior circumference surface of the guider such that the slider moves straightly along the guider.

5. The apparatus of claim 4, wherein the subsidiary guider comprises:

a key mounted to the exterior circumference surface of the guider; and a key guider formed at the interior circumference surface of the slider along the length direction of the slider.

6. The apparatus of claim 1, wherein the crankshaft and the guider are coupled to each other by a coupling unit.

7. The apparatus of claim 6, wherein the coupling unit comprises:

a screw hole which is formed at the end surface of the crankshaft;

a penetration hole penetrating through the guider along a length direction of the guider; and a bolt coupled to the screw hole after being inserted into the penetration hole.

8. A method for assembling a crankshaft-sprocket, comprising:

aligning a predetermined portion of an end potion of a guider to an end portion of a crankshaft using a second aligner;

aligning a timing mark of the sprocket to predetermined portion of a slider using a first aligner, after inserting the sprocket into the slider;

thrusting the aligned sprocket onto the crankshaft, after inserting the slider into the guider;

releasing the first aligner and drawing out the slider, after the sprocket is fixed to the crankshaft; and releasing the second aligner and separating the guider from the crankshaft.

9. The method of claim 8, comprising heating a sprocket before the inserting the sprocket into the crankshaft.

* * * * *